US008496449B2

(12) United States Patent
Knuth et al.

(10) Patent No.: US 8,496,449 B2
(45) Date of Patent: Jul. 30, 2013

(54) AIR DRIVEN HYDRAULIC PUMP

(75) Inventors: Bruce E. Knuth, Marshall, WI (US); Kay Lap Gilbert Chan, Madison, WI (US); Theo H. H. Den Ridder, Oosterhout (NL); Frantz D. Stanford, Monona, WI (US); Roger R. Pili, Madison, WI (US)

(73) Assignee: Actuant Corporation, Mchomonee Falls, WI (US)

( * ) Notice: Subject to any disclaimer, the term of this patent is extended or adjusted under 35 U.S.C. 154(b) by 451 days.

(21) Appl. No.: 12/515,221

(22) PCT Filed: Nov. 21, 2007

(86) PCT No.: PCT/US2007/085372

§ 371 (c)(1),
(2), (4) Date: Apr. 30, 2010

(87) PCT Pub. No.: WO2008/064303

PCT Pub. Date: May 29, 2008

(65) Prior Publication Data

US 2010/0215521 A1 Aug. 26, 2010

Related U.S. Application Data

(60) Provisional application No. 60/866,706, filed on Nov. 21, 2006.

(51) Int. Cl.
*F04B 35/00* (2006.01)

(52) U.S. Cl.
USPC ..... 417/375; 417/382; 417/441; 417/903

(58) Field of Classification Search
USPC ..... 417/375, 382, 539, 441, 470, 903
See application file for complete search history.

(56) References Cited

U.S. PATENT DOCUMENTS 1,067,770 A * 7/1913 Spohrer ..... 417/265
2,685,865 A * 8/1954 D Haem et al. ..... 91/220

(Continued)

FOREIGN PATENT DOCUMENTS

DE 20021980 U1 5/2002
DE 10149788 A1 4/2003

(Continued)

OTHER PUBLICATIONS

The International Search Report and Written Opinion as mailed on Apr. 29, 2008 for International Patent Application PCT/US2007/085372.

*Primary Examiner* — Devon Kramer
*Assistant Examiner* — Thomas Fink
(74) *Attorney, Agent, or Firm* — Quarles & Brady

(57) ABSTRACT

A rotary air motor driven hydraulic pump has separate pressure and return actuators and first and second stage eccentric driven pistons 180 degrees out of phase and driven by the motor through a gear reduction unit. The pressure and return actuators are on/off/proportional valves and the pump has two pressure relief valves with one adjustable from outside of the pump for a user to set a pressure limit of the pump. Above a certain output pressure limit, a bypass valve shunts flow in excess of that needed to precharge the second stage compression chamber from the first stage piston to an elastic reservoir from which the hydraulic fluid pumped by the pump is drawn. To make the pump stall at a certain output pressure, a pressure limiting valve can be used that cuts off the air supply to the pump at the desired output pressure.

13 Claims, 12 Drawing Sheets

U.S. PATENT DOCUMENTS

| | | | | | |
|---|---|---|---|---|---|
| 2,828,172 | A | * | 3/1958 | McDonald | 5/610 |
| 3,041,975 | A | * | 7/1962 | Johnston et al. | 417/401 |
| 3,597,121 | A | | 8/1971 | McClocklin | |
| 3,788,781 | A | * | 1/1974 | McClocklin | 417/401 |
| 4,074,612 | A | * | 2/1978 | Miller | 91/290 |
| 4,842,323 | A | | 6/1989 | Trickett | |
| 4,889,472 | A | | 12/1989 | Decker et al. | |
| 4,971,531 | A | | 11/1990 | Aikioniemi | |
| 4,974,674 | A | | 12/1990 | Wells | |
| 5,078,580 | A | * | 1/1992 | Miller et al. | 417/265 |
| 5,082,066 | A | * | 1/1992 | Schoeps | 173/178 |
| 5,383,771 | A | | 1/1995 | Ghode et al. | |
| 5,421,552 | A | | 6/1995 | Wang et al. | |
| 6,295,693 | B1 | * | 10/2001 | Chou | 15/330 |
| 6,295,913 | B1 | * | 10/2001 | Rothering | 91/38 |
| 6,415,704 | B1 | * | 7/2002 | Wang | 91/224 |
| 6,578,357 | B1 | | 6/2003 | Schmollngruber | |
| 6,846,162 | B2 | * | 1/2005 | Chou | 417/63 |
| 6,860,727 | B2 | | 3/2005 | Huang | |
| 7,240,642 | B2 | * | 7/2007 | Chou | 123/41.35 |
| 2004/0047747 | A1 | * | 3/2004 | Hsu | 417/375 |
| 2009/0169401 | A1 | * | 7/2009 | Digman | 417/375 |

FOREIGN PATENT DOCUMENTS

| | | | |
|---|---|---|---|
| EP | 1084349 | B1 | 11/2002 |
| EP | 1435456 | B1 | 6/2006 |

* cited by examiner

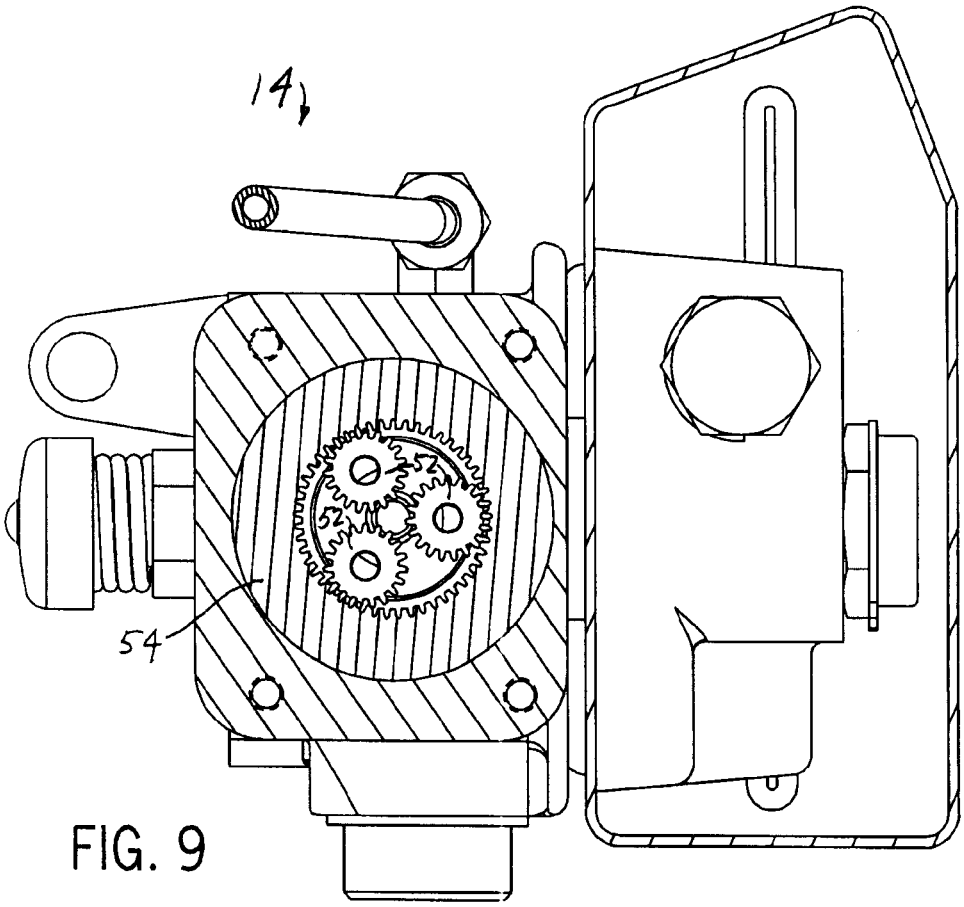
FIG. 9
FIG. 11
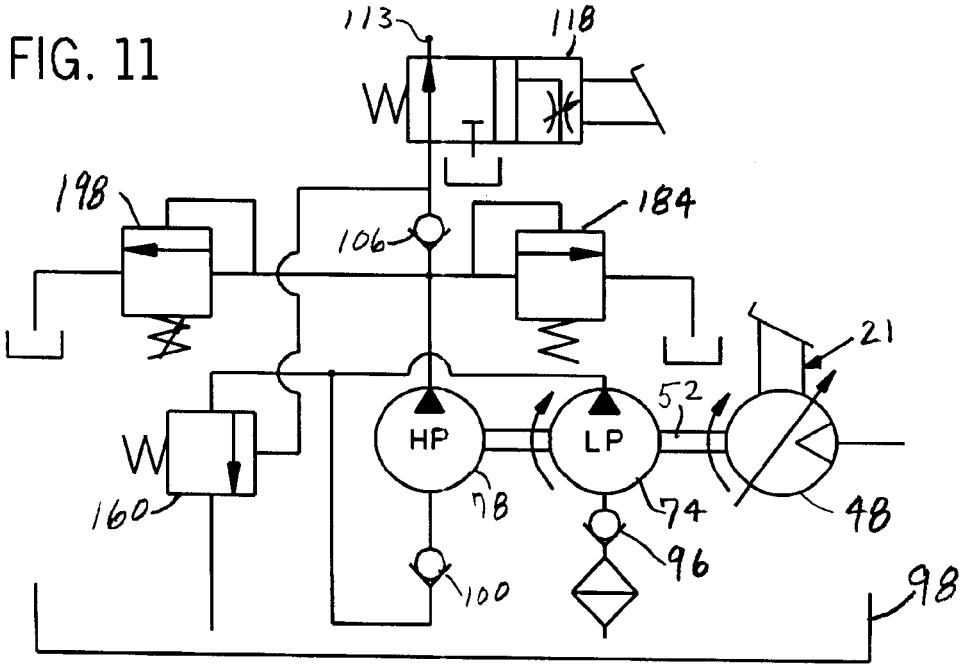

AIR DRIVEN HYDRAULIC PUMP

CROSS REFERENCE TO RELATED APPLICATIONS

This application represents the national stage application of International Application PCT/US2007/085372 filed 21 Nov. 2007, which claims the benefit of U.S. Provisional Patent Application 60/866,706 filed Nov. 21, 2006, which are incorporated herein by reference in their entirety for all purposes.

STATEMENT CONCERNING FEDERALLY SPONSORED RESEARCH OR DEVELOPMENT

Not applicable.

FIELD OF THE INVENTION

The present invention relates to fluid driven hydraulic pumps and, more particularly, to hydraulic pumps that are driven by an air motor

BACKGROUND OF THE INVENTION

Air motor driven hydraulic pumps are well known. A typical one of such pumps is disclosed, for example, in U.S. Pat. No. 4,074,612.

Most of these pumps are driven by a reciprocating air motor in which air at a pressure of about 120 psi acts on an air piston that drives a much smaller hydraulic piston to pump the hydraulic fluid. The pump is typically a single stage and operates as long as compressed air is introduced to it and it is turned on. It can be turned off, and also the treadle for operating it can be moved into a position to retract the hydraulic fluid back into the reservoir of the pump.

Such pumps are capable of generating hydraulic pressures of 10,000 psi or more, being only limited by the air pressure delivered to drive the device and by the ratio of the air piston and the hydraulic piston. At a given pressure of hydraulic fluid, these pumps would typically pump a certain flow rate, which rate went down as the hydraulic pressure went up in accordance with a certain relationship between the hydraulic pressure and the air pressure. This relationship was fixed, and was relatively continuous and gradual as the pressure changed. The result is that at high and low pressures, the performance was less than what could have been achieved with a more efficient machine.

In addition, in some applications metered delivery and metered return of fluid from the load, for example a hydraulic cylinder, is desirable, and prior pumps were lacking in this regard. Moreover, fluid contamination was sometimes an issue in these prior pumps.

SUMMARY OF THE INVENTION

The present invention provides an air driven hydraulic pump which can be provided in a relatively small form and addresses the above shortcomings.

In one aspect, the invention provides a pump that has a continuously variable and adjustable output flow rate by providing a pressure actuator valve that varies the flow rate of air supplied to the air motor of the pump.

In another aspect, the invention provides a pump that has a zero leak return valve that can be adjusted to continuously vary or completely turn off or on the return flow of hydraulic fluid from the load supplied by the pump.

In another aspect, the pressure and return actuators of the pump are operable independently of one another.

In another aspect, the invention provides a pump that can be operated in any orientation and with hydraulic fluid isolated from air exposure by an elastic bladder.

In another aspect, the invention provides a pump with a user adjustable pressure limit.

In another aspect, the invention provides a pump that can be operated to provide extremely high pressures. In this aspect, the pump can optionally be made to stall by using a hydraulically actuated air cut-off valve.

In another aspect, first and second stage pistons are used that are 180 degrees out of phase with respect to each other. They are preferably driven by a high speed rotary air motor through a gear reduction unit.

The foregoing and other objects and advantages of the invention will appear in the detailed description which follows. In the description, reference is made to the accompanying drawings which illustrate a preferred embodiment of the invention.

BRIEF DESCRIPTION OF THE DRAWINGS

FIG. 9 is a cross sectional view from the plane of the line 9-9 of FIG. 3;

FIG. 11 is a schematic circuit diagram of the pump;

DETAILED DESCRIPTION OF THE PREFERRED EMBODIMENT

Figure 1:
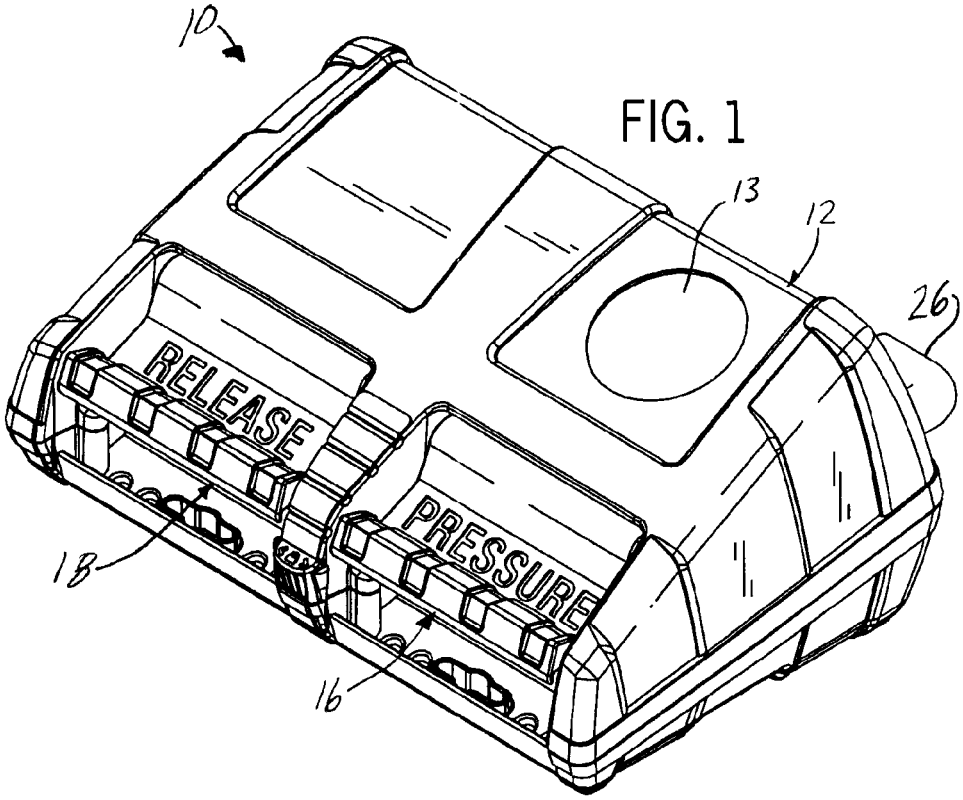
FIG. 1 is a perspective view of a pump incorporating the invention.
Figure 2:
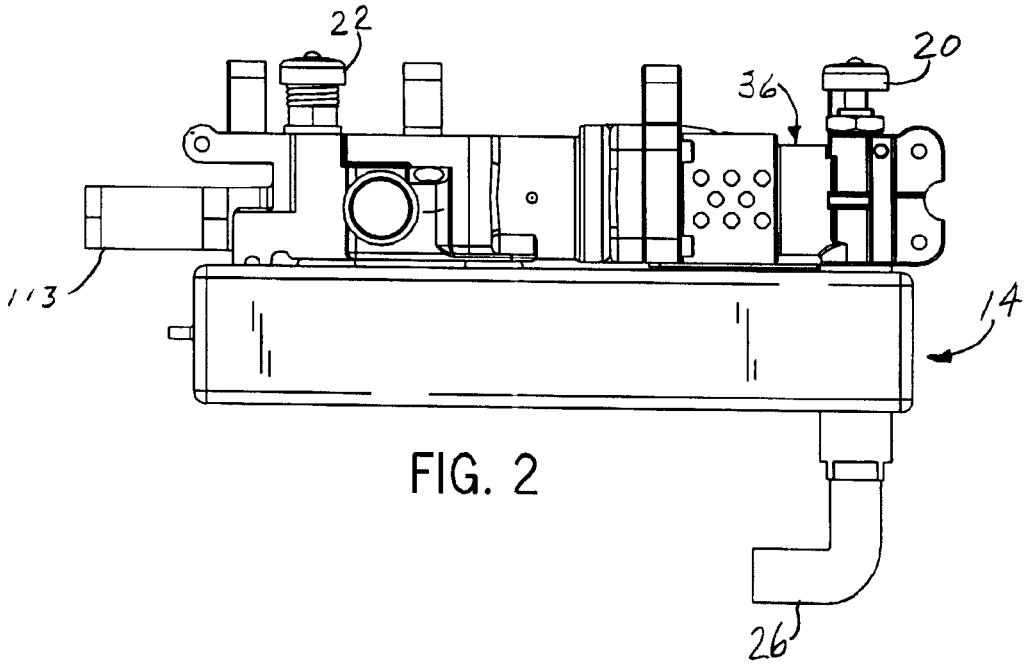
FIG. 2 is a bottom plan view of the pump removed from the housing.
Figure 3:
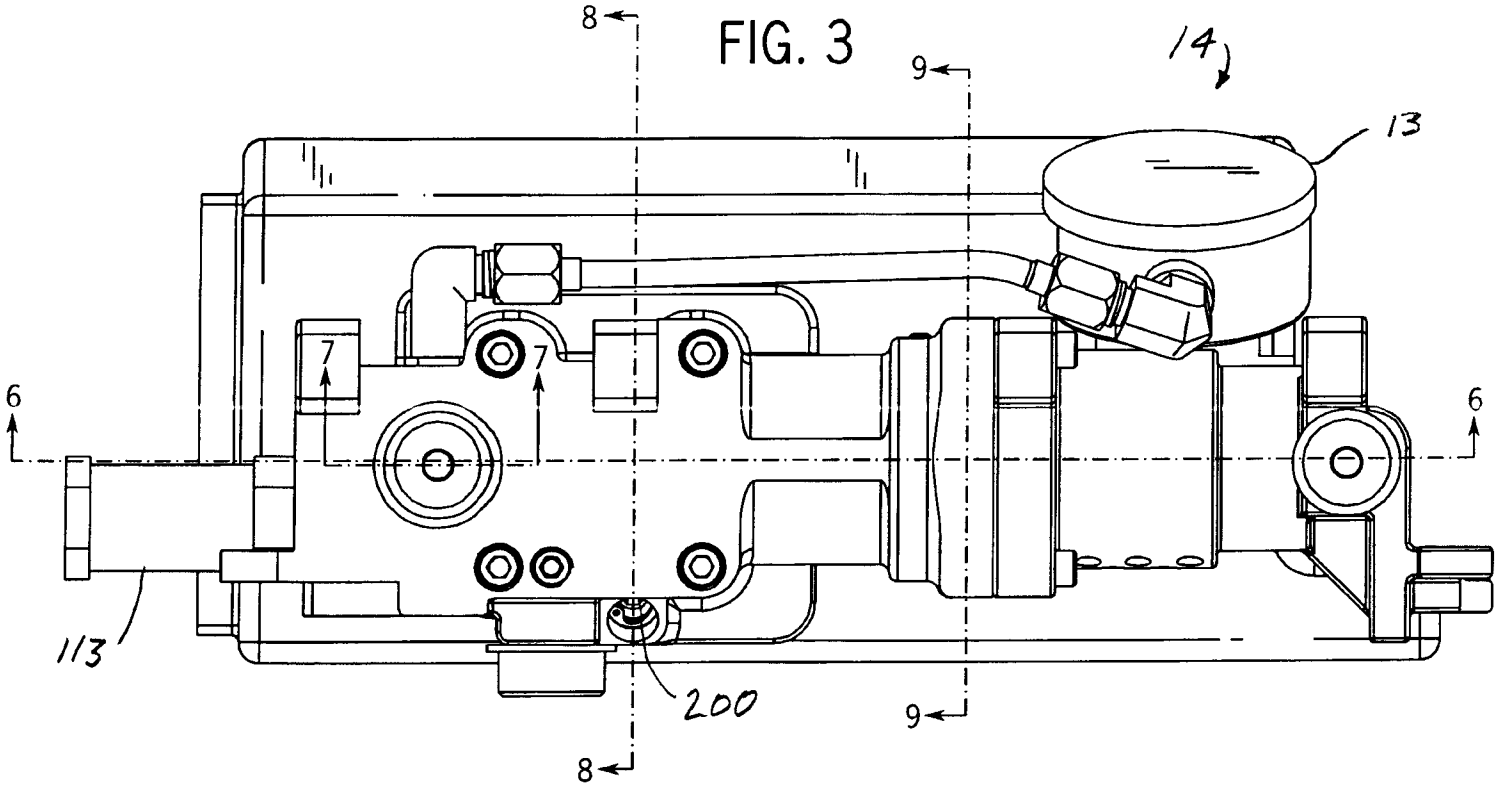
FIG. 3 is a front plan view of the pump.
Figure 4:
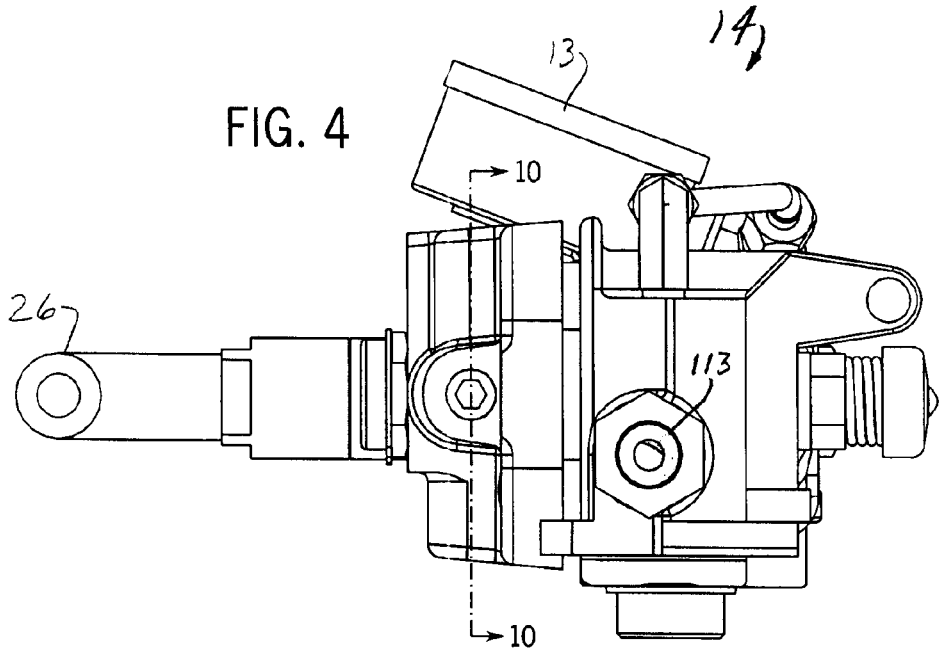
FIG. 4 is an end plan view from the left end as viewed in FIG. 2.
Figure 5:
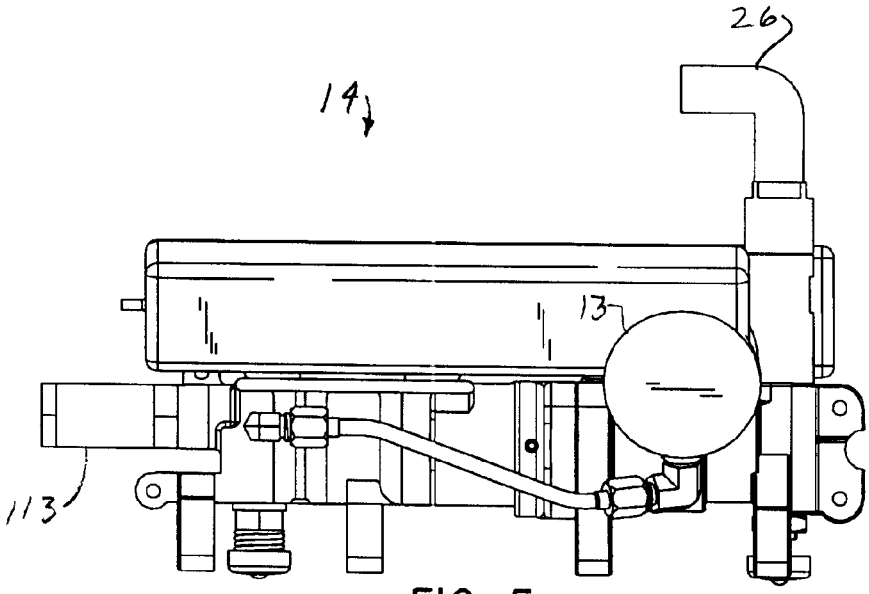
FIG. 5 is a top plan view of the pump.

Referring to FIG. 1, a pump 10 of the invention has a housing 12 and, referring to FIG. 2, a pump unit 14 inside the housing and secured to the housing by any suitable fasteners. The pump 10 includes a pressure actuator pedal 16 and a separate release actuator pedal 18 which, each of which are operable independently of the other. The pedal 16 presses on air valve actuator 20 (FIG. 2) when it is depressed and pedal 18 presses on hydraulic valve actuator button 22 when it is depressed. Both actuator buttons 20 and 22 and the corresponding pedals 16 and 18 are returned by springs to the fully extended or deactuated position in which neither air pressure is admitted to the pump 14 nor is the return of hydraulic fluid permitted to the pump, i.e., the return of fluid is blocked. The pedal 16 and 18 can either be operated by an operator's foot or they can be hand operated. Pressure gauge 13 may be provided readily visible on the top surface of the pump 10 to provide a measure of the hydraulic pressure output by the pump 10.

Figure 6:
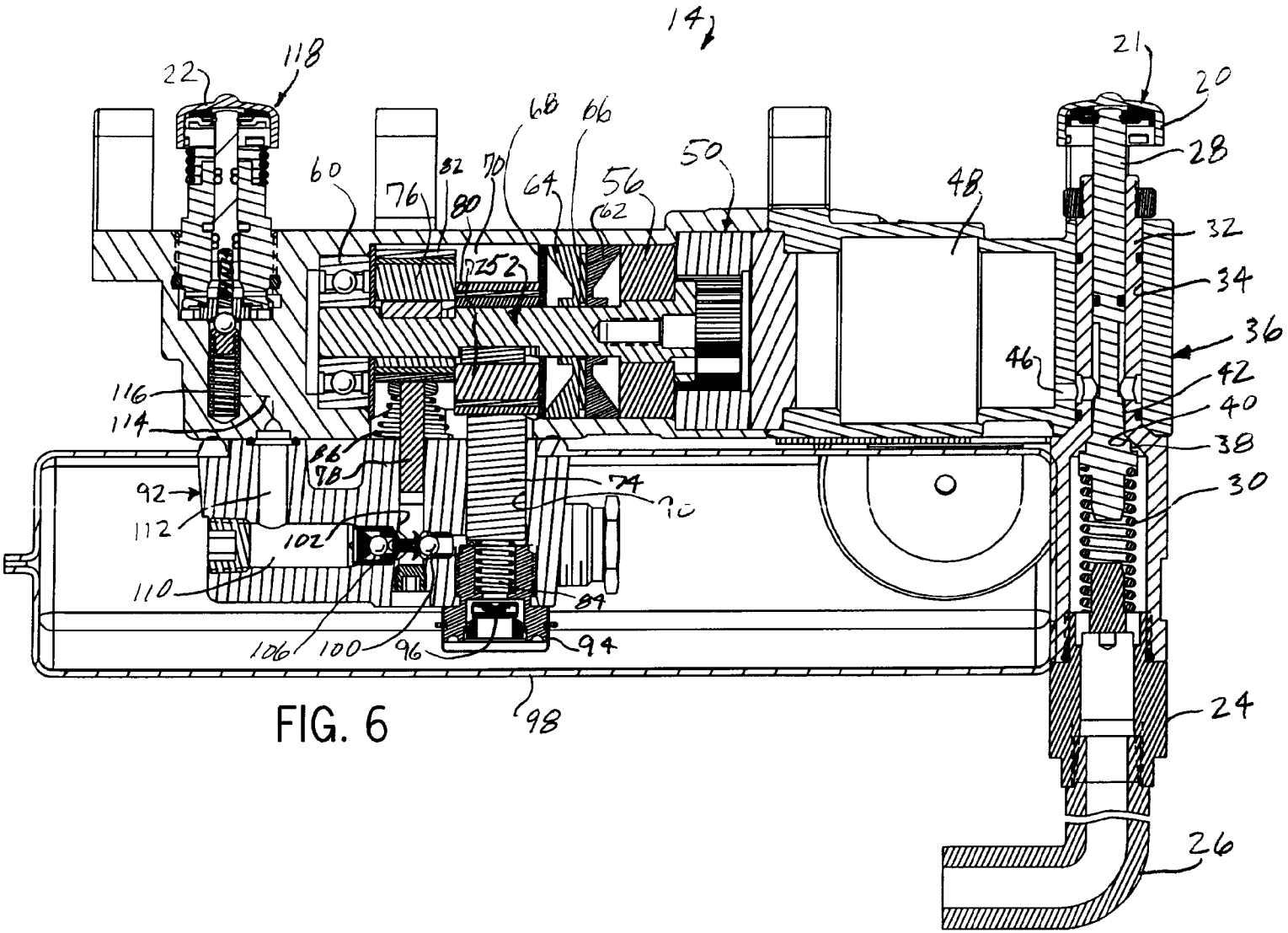
FIG. 6 is a cross sectional view from the plane of the line 6-6 of FIG. 3.

Referring to FIG. 6, air is input to the pump 10 via an air inlet port 24 which can have an elbow or any other suitable fitting attached to it. As stated above, the pressure pedal 16 bears against actuator button 20 which pushes on valve plunger 28 against the bias of spring 30. Plunger 28 slides axially in valve housing 32 which is threaded onto the air inlet port 24. Suitable O rings are provided to seal the interior of the valve housing 32, which is installed in a bore 34 of the pump unit housing 36. Stem 28 has an enlarged end or poppet valve head 38 that seats against a valve seat 40 of the housing 32. Head 38 is urged against the seat 40 by the spring 30. On the side of seat 40 opposite from spring 30, the side i.e. toward the actuator button 20, the stem 28 tapers in diameter at valve shank portion 42 so that the further that the stem 28 is pushed inwardly by pressing on actuator button 20, the greater the area between the valve seat 40 and the stem 28 so that the volume of air flow correspondingly increases with the amount that the stem 28 is depressed, i.e. with the amount that the pressure pedal 16 is depressed.

The inlet air valve 21 admits air from the inlet port 24 to an inlet port 46 in the valve housing 36 that leads to the inlet port of an air motor 48. The air motor 48 is a rotary air motor of any suitable type, preferably a sliding vane air motor of the type that is commonly available and often used in air tools such as nut drivers, power wrenches and the like. The air motor 48 would typically be a high speed air motor so as to generate sufficient power, for example, approximately 0.7 horsepower at an inlet air pressure of approximately 120 psi.

Because it is a high speed air motor, and the hydraulic pump is driven at a significantly lower speed, a sun gear reduction unit 50 is provided between the motor 48 and the hydraulic pump shaft 52. Three planetary gears 52 are mounted on shafts that stick out from the end of a flange that is part of the pump drive shaft 52 and mesh with ring gear 54 (FIG. 9). The planet gears 52 also mesh with the sun gear which is driven by the motor 48 and is coaxial with the shaft of the motor 48. Therefore, a significant reduction is obtained, for example, reducing a 20 to 25 thousand rpm air motor to a speed of 2,000 to 2,500 rpm at the pump shaft with a ten to one reduction. Other reductions may also be used.

The pump shaft 52 is journaled in the pump unit housing 36 by bearings 56 and 60 which may be ball bearings or any other suitable type of bearing. First and second lip seals 62 and 64 with a split washer 66 therebetween seal the hydraulic fluid pumping chamber, which is filled with hydraulic fluid typically, from the air motor and gearing chambers of the housing 36. A washer 68 separates the second seal 64 from the crank chamber 70. In the crank chamber 70, the shaft 52 has two circular eccentrics mounted on it that are 180° out of phase with respect to each other, one of the eccentrics 72 driving the first stage or high volume piston 74 and the other eccentric 76 driving the second stage or high pressure piston 78. Each eccentric 72 and 76 is secured to the shaft 52 with a key and keyway, with a journal bearing between the eccentric and an outer bearing race 80 or 82 that bears against the respective piston 74 or 78 to drive the respective piston in reciprocation. The piston 74 is biased against the outer bearing race 80 by compression spring 84 and the piston 78 is biased against the race 82 by compression spring 86.

Piston 74 reciprocates in bore 90 of piston block 92 and at the lower end of pumping chamber 90 an intake fitting 94 is threaded into the bore 90 that includes a one way check valve 96 that only admits fluid into chamber 90 and not out of chamber 90. Fitting 94 extends proximate to the rear wall of elastomeric bladder 98 that contains the hydraulic fluid and serves as the reservoir for it. Bladder 98 is elastic so as to change shape according to the amount of fluid contained therein, somewhat like a balloon filled with a liquid, which reduces contamination of the fluid and allows the pump to be operated in any orientation since the bladder 98 will always contract elastically to change shape so as to present a volume of fluid to the intake of the fitting 94, as long as there is a sufficient minimum quantity of fluid in the bladder 98.

On the intake stroke of the piston 74 fluid is sucked in from the bladder 98 into the pumping chamber 90 and on the pumping or compression stroke of the piston 74, it is pumped out past one way ball check valve 100 and into second stage pumping chamber 102 in which high pressure piston 78 reciprocates. On the pumping stroke of piston 74, piston 78 is retracting and so chamber 102 will be filled with fluid pumped by the piston 74 when the piston 78 begins its pumping stroke and piston 74 starts retracting. This is the result, in part, because the two pistons 74 and 78 are out of phase by 180° relative to one another. In addition, chamber 102 will be pre-charged with the pressure from the first stage piston pump, up to the lesser of either the load pressure or to the pressure at which the first stage relief valve opens, typically about 2,000 psi.

The excess fluid pumped from the first stage pumping chamber 90, that does not go to pre-charge second stage chamber 102, either gets pumped to the load past one way check valve 106 if the load pressure is less than the first stage relief valve pressure, or if the first stage relief valve is opened by the load pressure, then the excess fluid from the first stage pumping chamber gets directed back to tank through the first stage relief valve. When the first stage relief valve is open, due to the load pressure being high enough to open it, e.g., 2,000 psi or greater, the pressure at which the second stage chamber 102 is pre-charged is relatively low, substantially less then 2,000 psi, and may be only a few to a few hundred psi. When fluid flows past check valve 106, it flows into passageways 110 and 112 which lead back to the pump housing 36 and, as indicated by dashed line 114, to passageway 116.

Figure 7:
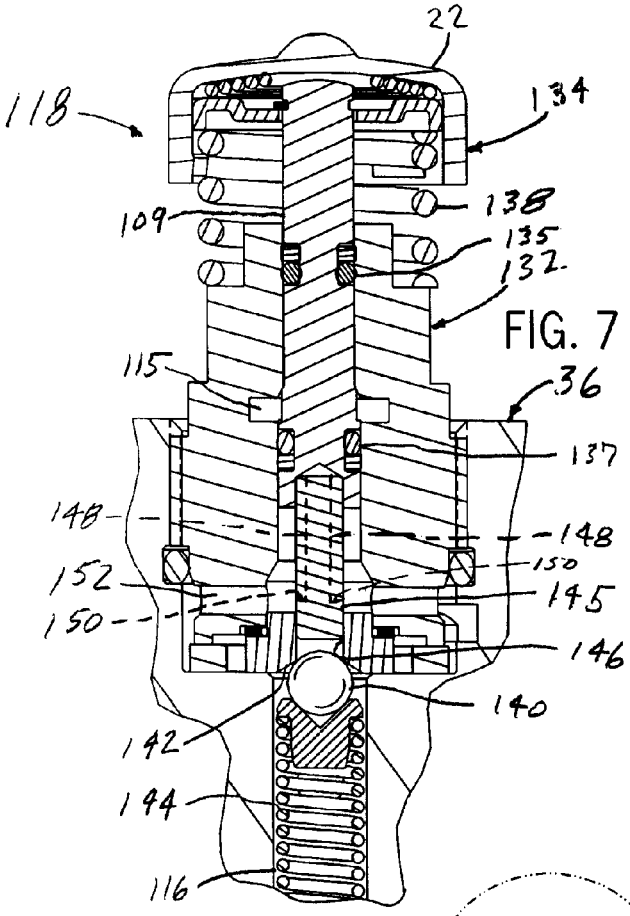
FIG. 7 is a detail view of the release valve shown in FIG. 6.

Referring particularly to FIG. 7, a proportional release valve 118, which is actuated by the pedal 18, controls the egress of fluid from passageway 116. Valve 118 has a housing 132 and an actuator 134 having a stem 109. Stem 109 is slideable axially in the valve body 132 and is biased upwardly into a closed position of the actuator by a spring 138. Valve body 132 is screwed into the pump housing 136 over the passageway 116 and stem 109 is sealed to the bore of valve body 132 in which it slides by suitable upper 135 and lower 137 sliding seals that define a pressure balance passageway 115 between them. Passageway 115 is in continuous communication with passageway 116 by suitable passageways formed in the valve body 132 and pump housing 136 and the area of the stem 109 below passageway 115 is slightly greater than the area above passageway 115 to induce a pressure bias that helps to move the stem 109 inwardly toward an open position.

Valve 118 has three states, being illustrated in the zero leak closed state in which ball 140 is seated on conical seat 142 under the bias of spring 144 that is situated in passageway 116, and hydraulic fluid flow through the valve to tank 98 is shut off. Actuator 134 can be moved downwardly to push the ball 140 off of seat 142, by pushing pin 145, with the pin 145 sliding in bore 146 that is adjacent to the seat 142. Pin 145 has a lower end that is slightly smaller than the bore 146 so as to substantially fill the bore 146 with only a small clearance sliding fit between the pin 145 and the bore 146. The upper portion of the pin 145. as indicated by dashed lines 148, has flattened sides or longitudinal grooves in the plane perpendicular to plane illustrated, so that when the pin 145 is pushed through the bore 146 so that shoulders 150 extend out of the bore 146, a full flow of fluid from chamber 116 to chamber 152 is permitted through the passageways 148. Thus, the three states of the valve are the fully closed position as shown in FIG. 7, with the ball 140 seated against the seat 142, a second metering position in which the length of the lower, cylindrical portion of the pin 145 that overlaps in the bore 146 determines the flow rate from passageway 116 to passageway 152 that depends on the overlapping length, with a longer overlapping length permitting less flow and a shorter overlapping length permitting more flow, and the third state being a fully open state in which the actuator stem 109 is pushed all the way in and the shoulders 150 are pushed all the way through and out of the bore 146, past the edge between the bore 146 and the seat 142, to permit direct communication between the bore 116 and the bores 152 through the passageways 148 of the pin 145. It is noted that the ball 140 could either be provided as a separate ball as shown, or as a ball end formed on the end of pin 145. Alternatively, a conical end could be formed on the end of pin 145 to seat against a mating poppet seat. Thus, the release valve 118 is a continuously actuable zero leak-off, proportional and full-on valve in that the rate of fluid flow being returned from the load from passageway 116 to passageways 152 is infinitely adjustable from zero to full-on and determined by how far inwardly the stem 109 is depressed. Passageway 152 is connected by internal passageways (not shown) to direct fluid back into the bladder 98. Passageway 116 is connected to the pump out port via internal passageways including passageways 110, 112 and 114, which are also connected to the hydraulic input/output port 113 for fluid communication with the load.

Figure 15:
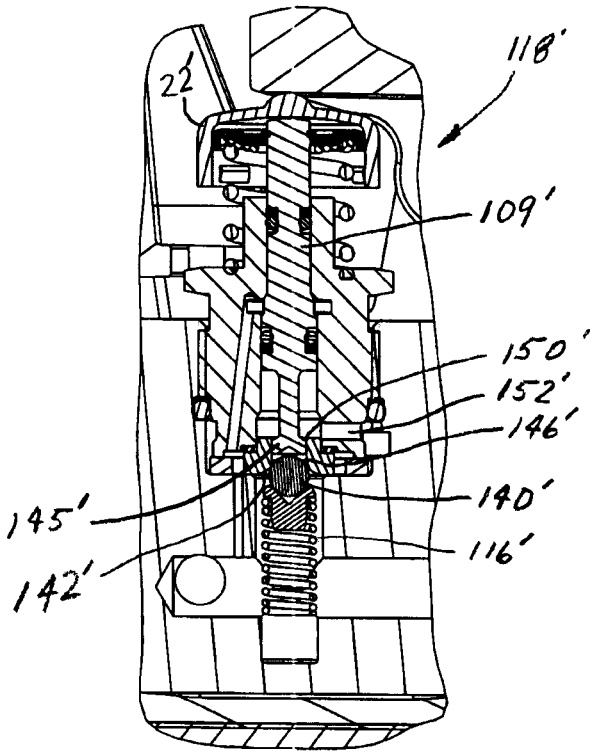
FIG. 15 is a cross sectional view of an alternate release valve for the pump.

FIG. 15 illustrates an alternate release valve 118', which is essentially the same as valve 118, except pin 145' is formed integrally with the stem 109', the part of the pin above shoulder 150' has a circular cross section of a reduced diameter (rather than a larger diameter with grooves 118 like in valve 118) and a conical shaped depression is formed in the bottom of the pin 145' to position and guide the ball 140'. Parts of the valve 118' corresponding to parts of the valve 118 are labeled with the same reference number plus a prime (') sign. The valve 118', like valve 118, has three states, fully closed, metering and fully open. The closed state is shown in FIG. 15, with the ball 140' seated against the seat 142'. In the next position, the metering position, when the valve is being opened, the length of the lower portion of the pin 145' that overlaps in the bore 146', and that is nearly as large as the bore 146', determines the flow rate from passageway 116' to passageway 152'. The flow rate during metering depends on the overlapping length of the lower portion of pin 145' in the bore 146', with a longer overlapping length permitting less flow and a shorter overlapping length providing more flow. In the fully open state, the shoulder 150' pushed all the way through and out of the bore 146', past the edge between the bore 146' and the seat 142', to permit direct communication between the bore 116' and the bores 152'. It is noted that the ball 140' could either be provided as a separate ball as shown, or as a ball shaped or cone shaped end formed on the end of pin 145'.

Figure 10:
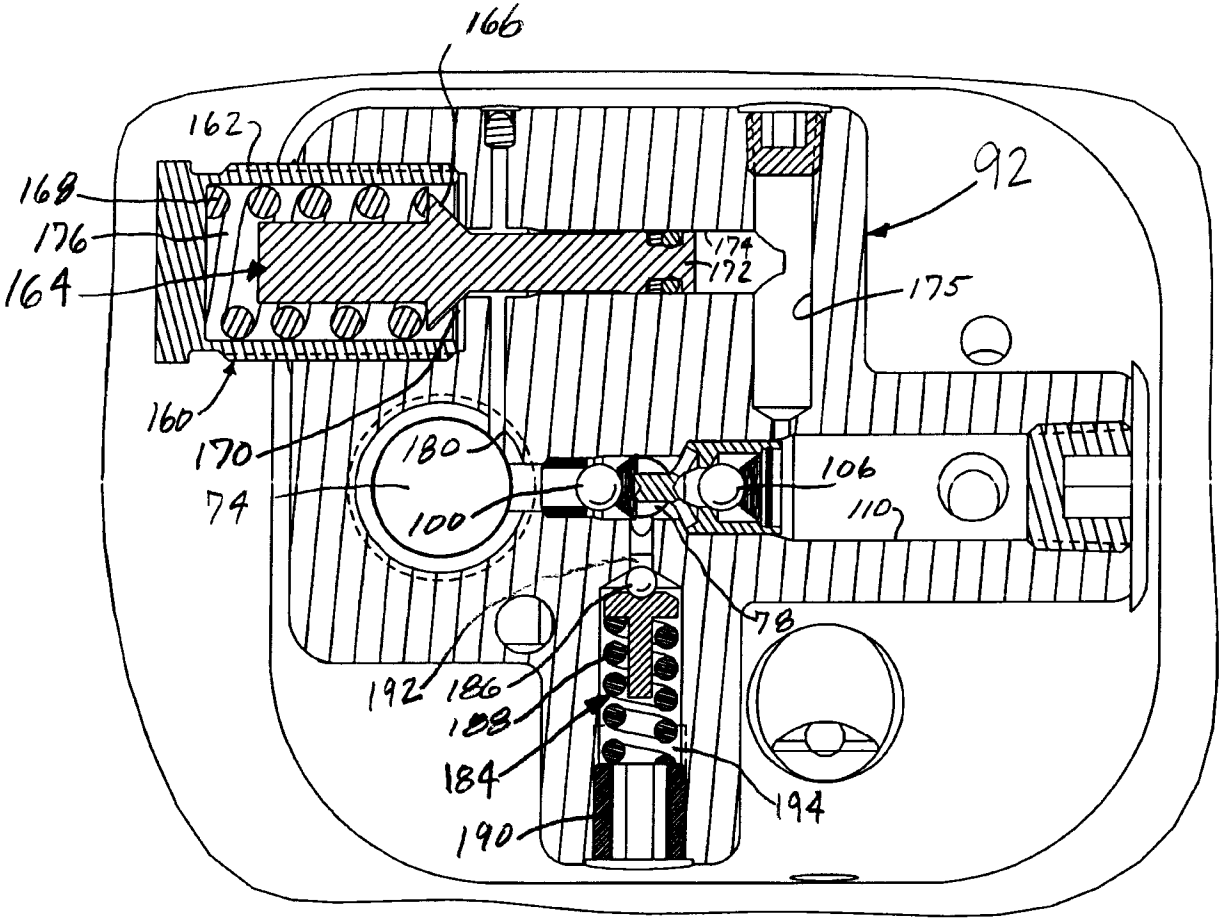
FIG. 10 is a cross sectional view from the plane of the line 10-10 of FIG. 4.

Referring to FIG. 10, the first stage pressure relief or bypass valve 160 referred to above is located in the piston housing 92. The bypass valve 160 has a valve body 162 that is screwed into the housing 92 and a valve element 164 has an enlarged poppet valve conical section 166 that is biased by spring 168 against valve seat 170 to normally close the valve 160. Valve element 164 also has a piston section 172 that slides in a bore 174 that is connected to a passageway 175 that communicates with the load pressure in passageway 110. When the load pressure, i.e. the pressure downstream of the second stage piston 78, which may also be referred to as the output pressure of the pump, exceeds about 2,000 psi, the bias of spring 168 is overcome since that pressure will act on piston 172 to move the element 164 leftwardly as shown in FIG. 10, to unseat the poppet section 166 from the seat 170 and permit fluid from the output of the first stage piston 74 to flow via passageway 180 past the seat 170 into the chamber 176, which is in fluid communication with the interior of the bladder 98 by passageways not shown.

Also shown in FIG. 10 is an internal or factory adjustable pressure relief valve 184 including a ball 186 held against a poppet seat by a spring 188 the force exerted by which is adjustable by a valve spring adjuster 190 that is threaded into the housing 92 and bears against the end of spring 188. When the passageway 192, which is in communication with the pumping chamber of second stage piston 78, exceeds the amount necessary to overcome the force of spring 188, which is set by adjuster 190, ball 186 moves off of its seat to relieve pressure from passageway 192 into passageway 194 which is connected to the tank pressure, i.e. the pressure inside bladder 98, by passageways not shown.

Figure 8:
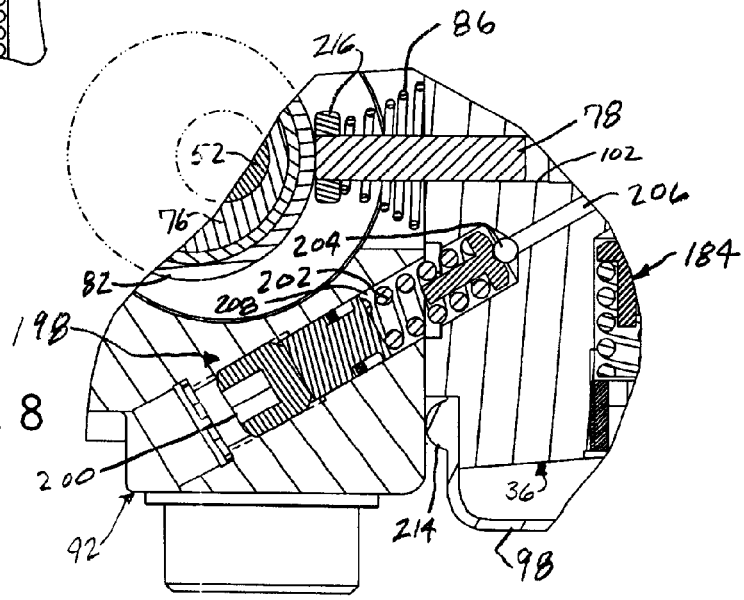
FIG. 8 is a cross sectional view from the plane of the line 8-8 of FIG. 3.

Referring to FIG. 8, a user adjustable pressure relief valve 198 is also provided in the pump 10. This valve works like the valve 184, except the adjuster 200 is accessible by a user with an alien wrench from outside of the pump unit. This way, if the factory setting for the pressure relief valve 184 is at 10,000 psi, but the user desires 8.000 psi, the user can cause the pressure to be limited to 8,000 psi by adjusting the adjuster 200. In addition to including the adjuster 200, the valve 198 includes a spring 202 and a ball 204. The ball 204 separates passageway 206, which is in communication with the pump output pressure, from the passageway 208 which is in communication with the tank pressure. FIG. 8 also shows the edge of the bladder 98, indicated at 214, which is formed in a bulbous shape so as to provide a gasket between the housings 92 and 36 and the bladder 98. Also, still referring to FIG. 8, the piston 78 has a washer 216 which is affixed (for example pressed on) to its end adjacent the outer bearing race 82 against which spring 86 acts to retract the piston 78.

FIG. 11 illustrates a schematic circuit diagram for the pump 10. Elements in FIG. 11 corresponding to the physical elements described above are labeled with the same reference number. On/off/proportional air valve 21 controls the speed of rotary air motor 48 from zero to full speed, to drive the pump shaft 52 that drives both the low pressure pump 74 and the high pressure pump 78, to vary the pumping rate. Pump 74 draws fluid from the reservoir 98 via one way check valve 96 and pumps it through one way check valve 100 into the compression chamber of high pressure pump 78. High pressure pump 78 pumps its output through one way check valve 106 to be output from the pump at port 113 when the release valve 118 is in its normal position as illustrated. If the pressure of the high pressure pump 78 output is sufficiently high, it shifts first stage bypass valve 160 to redirect the output of the low pressure pump 74 in excess of that needed to pre-charge pump 78 to the tank 98. If the release valve 118 is actuated, which would normally be done when the pressure valve 21 is not actuated, valve 118 is shifted to its rightward position in which the load pressure is directed through variable release valve 118 to tank, either at a metered rate or fully opened, along with any output of the high pressure pump 78 if the valve 21 was operated while the release valve 118 was opened. Factory pressure relief valve 184 relieves pressure from the high pressure pump 78 in excess of a preset factory limit, for example 10,000 psi, and user adjustable pressure relief valve 198 relieves pressure at a user adjustable pressure less then the factory set pressure limit.

The disclosures of U.S. Provisional Patent Application No. 60/829,777 filed Oct. 17, 2006 entitled, "Zero-Leak Variable Rate High Pressure Metering Valve" and of U.S. Provisional Patent Application No. 60/863,078 filed Oct. 26, 2006 entitled, "Hydro-Pneumatic Pressure Limiting Valve" are attached as Exhibits A and B respectively to U.S. Provisional Application No. 60/866,706 filed Nov. 21, 2006, of which the present application claims priority and which disclosure is incorporated by reference above. PCT Application No. US2007/081389 filed Oct. 15, 2007 claims the benefit of the former provisional application and is substantially identical thereto and PCT Application No. US/2007/082504 filed Oct. 25, 2007 claims the benefit of the latter provisional application and is substantially identical thereto, and are hereby incorporated by reference. The former provisional patent application discloses a valve that may be used as the release valve 118 described above. The latter provisional application discloses a valve that controls the flow of air and is actuated by a hydraulic pressure such that if the hydraulic pressure output by the pump reaches a certain threshold, the valve shuts off the flow of air to the pump. This valve would have its hydraulic input in communication with port 113, its air input connected to the air supply for the pump and its air output port connected to the air input port 26 of the pump 10. Alternatively, the valve 21 could be removed and this shut-off valve put in its place. Such a valve is especially useful in applications where the pump must shut off or is desirable to shut off when a certain hydraulic pressure is reached, for example in work holding applications where the pump is used to actuate cylinders that hold a workpiece, for example while it is being machined or having another operation performed on it. The pump described herein may not necessarily shut off ever or be stalled by a high hydraulic load pressure because of the high gear reduction of the air motor and the fact that as the pistons approach top dead center, the moment arm driving the pistons becomes infinitely small so that extremely high pressures can be pumped by the pump, without stalling the motor. Leakage in the pump also plays a factor in why the pump may not stall unless a positive shut-off valve as described below is used.

Figure 12:
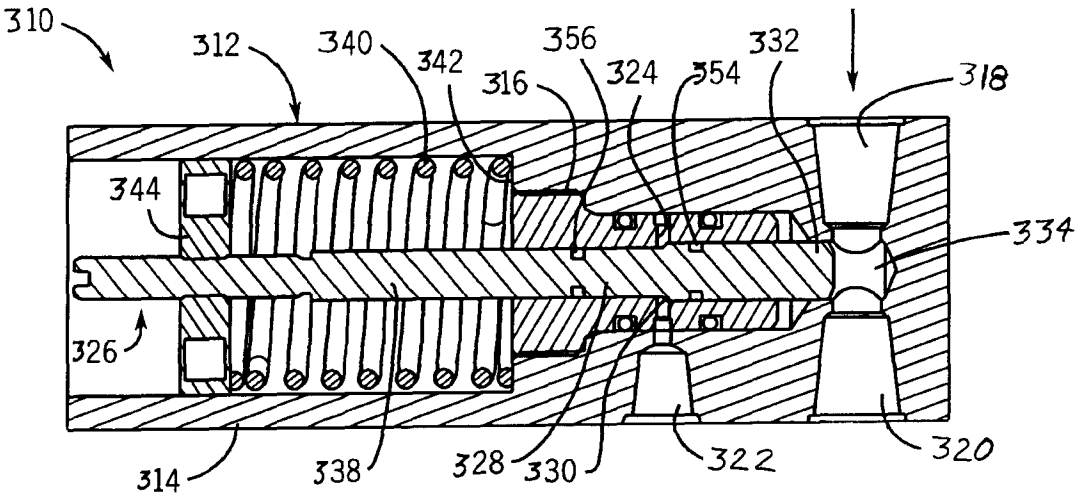
FIG. 12 is a cross sectional view of a hydraulically actuated air cut-off valve that can be used with the pump, in an open or on state.
Figure 14:
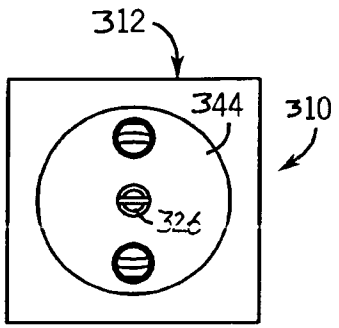
FIG. 14 is a left end view of the valve of FIGS. 12 and 13.
Figure 13:
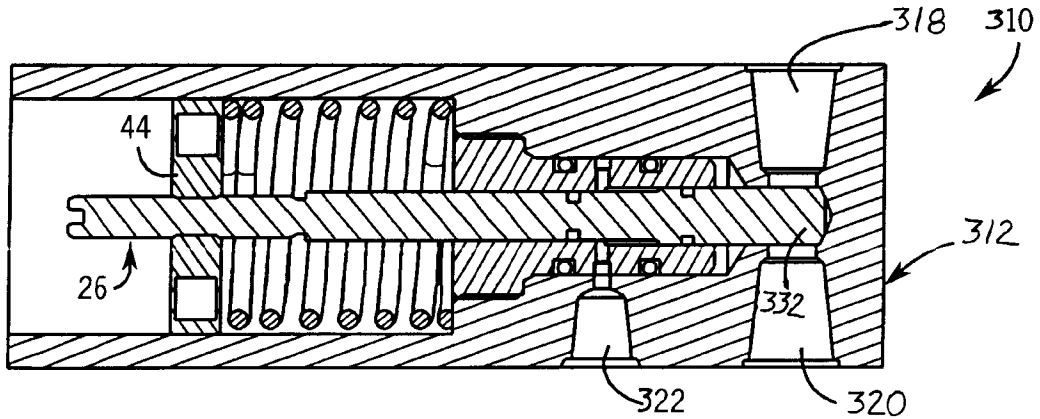
FIG. 13 is a view like FIG. 12, but in a closed or off state.

Referring to FIGS. 12-14, a valve 310 of the invention has a housing 312 that includes a valve block 314 and a cartridge 316 that is screwed into the block 314. Valve block 314 has an air inlet port 318 and an air outlet port 320. Block 314 also has a hydraulic fluid sense port 322 that is in communication with chamber 324 of cartridge 316. A valve element 326 extends through chamber 324 and has a hydraulic section 328 having an unbalanced area 330 that is inside the chamber 324 and a pneumatic section 332 that is extendable into a bore 334 that extends between the two air ports 318 and 320. Section 332 fits closely with bore 334 in a sliding fit so that when section 332 is extended into bore 334 section 332 closes off fluid communication between the ports 318 and 320, as shown in FIG. 12.

In the valve 310, valve element 326 extends leftwardly from the cartridge 316 to a spring portion 338 surrounded by a compression spring 340 that is compressed between axially facing surface 342 of body 314 and a spring reaction member 344 that is threaded on the end of spring section 338 of the valve element 326. Turning the element 344 relative to the valve element 326 either compresses the spring more in one direction or relieves the compression on the spring 340 in the other direction to adjust the amount of spring biasing force on the element 326, which force biases the element 326 to move the pneumatic section 332 into the open position.

Hydraulic fluid introduced to the hydraulic fluid sense port 322 of the valve 310 acts on the unbalanced area 330 in the chamber 324. Unbalanced area 330 is created by a difference in diameter in the element 326 that occurs between sliding seals 354 and 356, that creates a shoulder at the junction between the two diameters, identified at 330 in FIG. 12. A sufficient hydraulic pressure in chamber 324 acting on area 330 to overcome the force of air pressure acting on section 332 and the force of the spring 340, both of which act toward the left as viewed in FIG. 12, moves the element 326, and particularly the pneumatic section 332, to the right as viewed in FIG. 12. Port 318 communicates with one side of bore 334 and port 320 communicates with the other, so the presence of section 332 extended into the bore 334 completely closes communication between the air inlet port 318 and the air outlet port 320 as shown in FIG. 12 except for leakage, which is negligible. Air outlet port 320 would be in communication with the inlet port of the air motor 48, to supply air or shut off air to the inlet port of the motor 48, and could be housed in the housing 36 or outside of the housing 36, but in either event would need as an input to port 322 the output pressure from the pump 14, so port 322 would need to be in communication with the pressure at hydraulic input/output port 113 for fluid communication with the load.

Referring to FIG. 12, air can flow freely from air inlet port 318 to air outlet port 320 in the open position of element 326, transversely through the bore 334, to supply compressed air to inlet port of motor 48, either through the valve 21 or directly to the motor 48. Motor 48 drives the hydraulic pump to pump hydraulic fluid to the load through port 113 and through valve 118, when valve 118 directs the fluid to the load and not back to tank. The pressure of the pump, either upstream or downstream of the valve 118, is in communication with the unbalanced area 330 via port 322. When the pressure at port 322 reaches a high enough value, the force exerted by the hydraulic pressure on area 330 urges the valve stem 326 to the right, overcoming the force of spring 340, to close bore 334 and stop fluid communication from port 318 to port 320. This stops the air motor 48 which correspondingly stops driving the pumps 74 and 78. However, should the pressure at port 322 go down, spring 340 will overcome the hydraulic fluid force on area 330 to open communication between the air ports 318 and 320 and drive motor 48 to once again raise the pressure exerted on the load at port 113 until the pressure limit of valve 310 is once again reached to turn off the flow of air.

In addition, it should be noted that the retract valve 118 or the advance valve 21 could be easily replaced with other valves, such as joy sticks that could be more readily hand operated, since these valves are cartridge like valves that can be easily assembled and disassembled from the pump housing 36.

Figure 16:
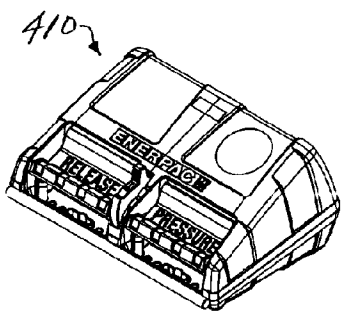
FIG. 16 is a perspective view of a second embodiment of a pump of the invention.
Figure 17:
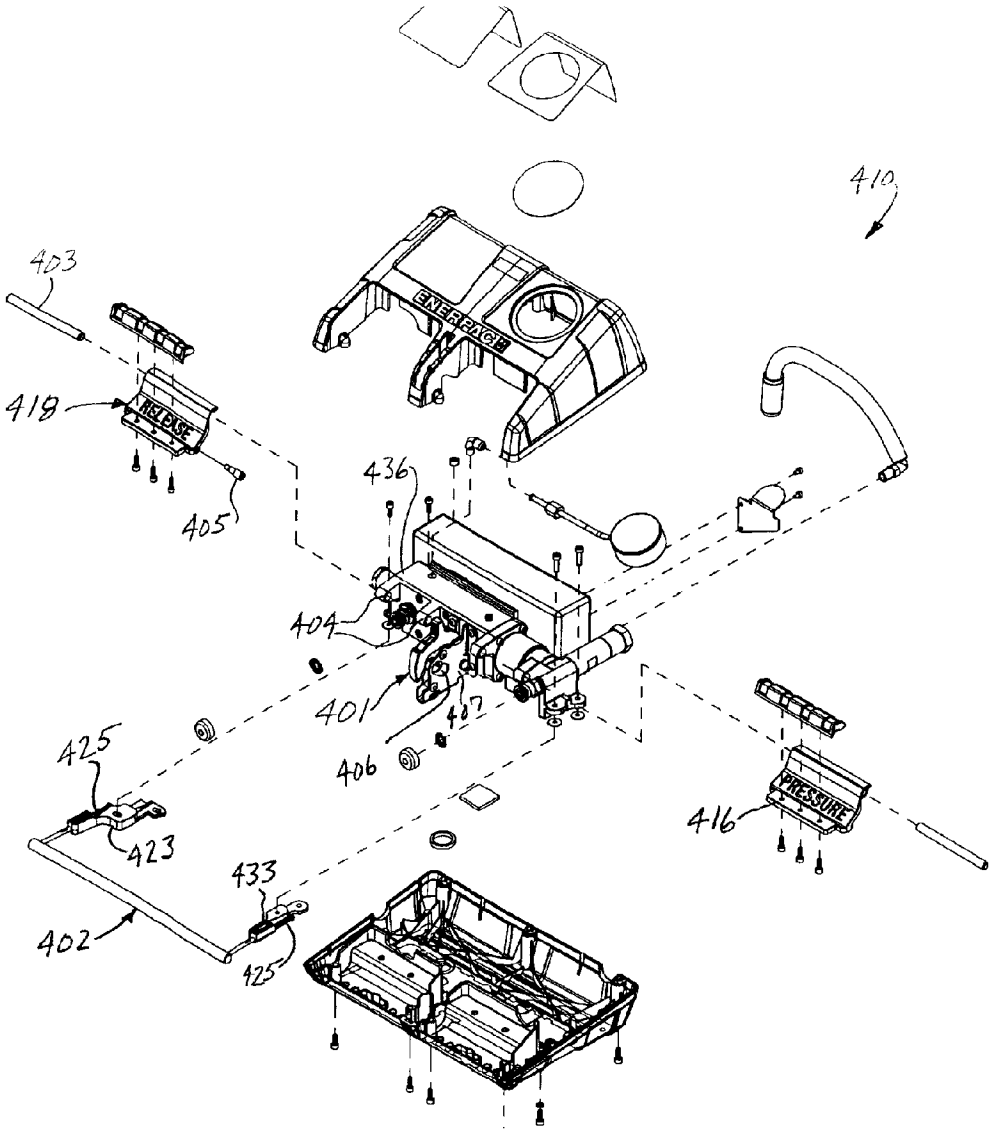
FIG. 17 is an exploded perspective view of the pump of FIG. 16.
Figure 19:
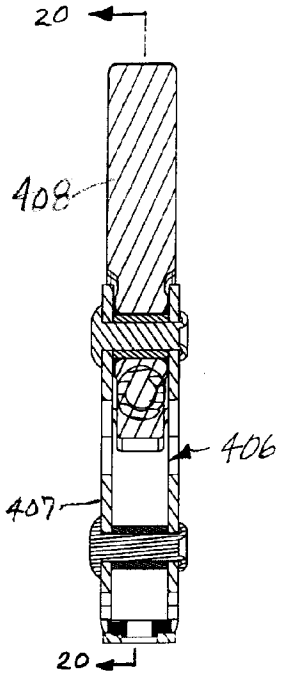
FIG. 19 is a cross sectional view from the plane of the line 19-19 of FIG. 18.
Figure 18:
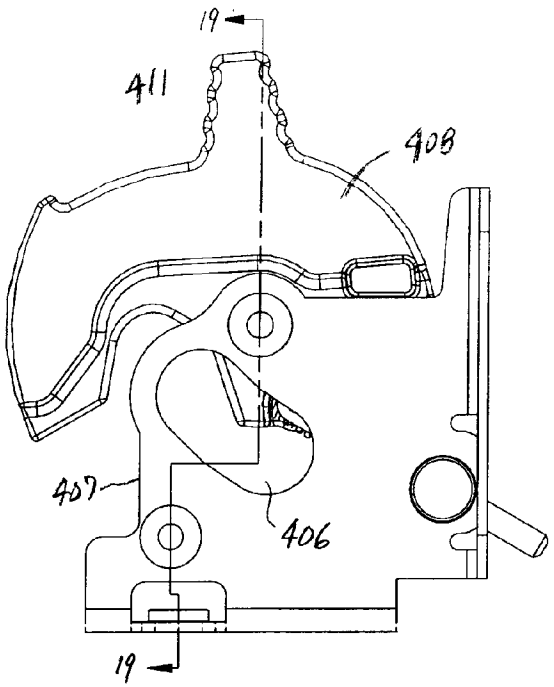
FIG. 18 is a side view of the lock mechanism of the pump of FIGS. 16 and 17.

FIG. 16 illustrates an alternate pump 410 which is essentially the same as the pump 10 except it has a lock mechanism 401 between the release and pressure pedals, the pump housing 436 is made of aluminum rather than steel and it has a carrying handle 402. Corresponding elements are labeled with the same reference number plus 400. FIG. 17 illustrates details of the assembly of the components of the pump 410. The housing 436 has a uniform external shape, such that it may be made from an aluminum extrusion, with subsequent machining to produce the various bores, threads and cross-sections.

Figure 20:
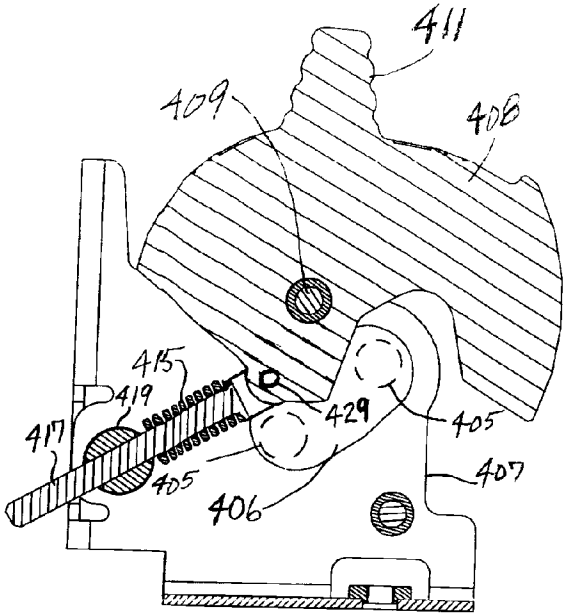
FIG. 20 is a cross sectional view from the plane of the line 20-20 of FIG. 19.

One feature of the pump 410 not present in the pump 10 is the ability to hold the release pedal in the open or released (pedal actuated down) position. Referring to FIG. 17, the release pedal 418 is pivoted to the housing 436 by pivot pin 403 which extends through an opening in the back of the pedal 418 and is received in suitable ears 404 of the housing 436. A pin 405 is screwed into the near end of release pedal 418 and extends into the left side (from the front of the pump 410) of a kidney shaped opening 406 in the frame 407 of the lock mechanism 401. The pin 405 is drawn in phantom in two different positions in FIG. 20, the upper position being with the release pedal 418 up, i.e., not actuated, and the lower position being with the pedal 418 pushed down, i.e., actuated. The lock mechanism 401 has a rotor cam 408 with a handle 411 that can be rotated about pivot 409 to move pin from the upper position to the lower position. Spring 415 provides an over-center force on the cam 408 that keeps it in either rotary position, so it will hold the pin 405 in the lower position when the cam 405 is rotated to that position, and will permit the pin 405 to return to the upper position when the cam 405 is rotated counterclockwise as viewed in FIG. 20. Compression spring 415 exerts a force between a shoulder of pin 417 and pin 419. Pin 419 can pivot about its own axis and pin 415 extends through a hole in pin 419 and can slide in the hole. The upper end of pin 417 is forked and pinned by pin 429 to the cam 408 to establish a pivot connection therewith about the axis of pin 429. The pressure pedal 416 could also be made to be held actuated by the cam 408, by screwing a pin 405 into the end of the pedal 416, with the pin extend from the pedal 416 into the kidney shaped space 406 to be held down by the cam 408, as may be desired in some applications.

The handle 402 slides in brackets 423 and 433 and is normally retracted so as not to interfere with operation of the pedals by compression springs 425. When carrying the pump 10 by the handle 402, the springs 425 compress to extend the handle 402 so as to make room for the user's hand.

A preferred embodiment of the invention has been described in considerable detail. Many modifications and variations to the embodiment described will be apparent to those skilled in the art. Therefore, the invention should not be limited to the embodiment described, but should be defined by the claims which follow.

The invention claimed is:

1. An air driven hydraulic pump, comprising: an air motor; an air inlet; an air valve between the air inlet and the air motor; a rotary drive shaft driven hydraulic pumping unit driven by the air motor; a reservoir in communication with the hydraulic pumping unit to supply hydraulic fluid to a compression chamber of the pumping unit; at least one port for connection to a hydraulic device to be powered by the hydraulic fluid from the hydraulic pump; and a hydraulic fluid return valve controlling the return of the hydraulic fluid from the hydraulic device to the hydraulic pump; a housing to which the air motor, the air valve, the hydraulic pumping unit, the reservoir and the return valve are secured, the housing forming an outer surface of the hydraulic pump; wherein the housing has a pressure actuator pedal forming part of the outer surface of the housing at a side edge of the housing depressible into the housing by a foot of an operator at the side edge of the housing for actuating the hydraulic pump to pump hydraulic fluid to a hydraulic device and the housing has a release actuator pedal forming part of the outer surface of the housing at the side edge of the housing depressible into the housing by the foot of the operator at the side edge of the housing for returning hydraulic fluid from the hydraulic device, the release actuator pedal being operable independently of the pressure actuator pedal.

2. An air driven hydraulic pump as in claim 1, wherein the air motor is a rotary motor.

3. An air driven hydraulic pump as in claim 1, wherein the air motor is a rotary motor and the hydraulic pump is an eccentric driven radial piston pump.

4. An air driven hydraulic pump as in claim 3, wherein the hydraulic pump is a two stage pump with a single first stage piston and a single second stage piston.

5. An air driven hydraulic pump as in claim 4, wherein the two pistons are 180 degrees out of phase with respect to each other.

6. An air driven hydraulic pump as in claim 4, wherein the first stage piston precharges the second stage piston.

7. An air driven hydraulic pump as in claim 5, wherein there is a gear reduction between the air motor and the shaft that drives the eccentric driven radial piston pump.

8. An air driven hydraulic pump as in claim 1, wherein the hydraulic fluid return valve is a valve that can be operated to stop fluid flow from the hydraulic device or to vary a return rate of fluid flow from the hydraulic device.

9. An air drive hydraulic pump as in claim 1, wherein the hydraulic pump has two relief valves with at least one of the relief valves being accessible from an exterior of the hydraulic pump so that the at least one of the relief valves is adjustable by the operator to set a pressure limit of the hydraulic pump.

10. An air driven hydraulic pump as in claim 1, wherein the reservoir includes an elastic bladder in which the hydraulic fluid is contained in reserve to be pumped by the hydraulic pump.

11. An air driven hydraulic pump as in claim 1, further comprising a pressure limiting valve that turns off air to the air motor at a certain hydraulic output pressure of the hydraulic pump.

12. An air driven hydraulic pump as in claim 1, further comprising a mechanism to lock the return valve in an actuated position.

13. An air driven hydraulic pump as in claim 1, further comprising a mechanism to lock the air valve in an actuated position.

* * * * *

UNITED STATES PATENT AND TRADEMARK OFFICE

CERTIFICATE OF CORRECTION

PATENT NO. : 8,496,449 B2
APPLICATION NO. : 12/515221
DATED : July 30, 2013
INVENTOR(S) : Knuth et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 902 days.

Signed and Sealed this
Fifteenth Day of September, 2015

Michelle K. Lee

Michelle K. Lee
*Director of the United States Patent and Trademark Office*